United States Patent [19]

Bouchard et al.

[11] Patent Number: 5,027,030

[45] Date of Patent: Jun. 25, 1991

[54] GLOW DISCHARGE LAMP HAVING ZERO ANODE VOLTAGE DROP

[75] Inventors: Andre C. Bouchard, Peabody; Radomir Lagushenko; Jakob Maya, both of Brookline, all of Mass.

[73] Assignee: GTE Products Corporation, Danvers, Mass.

[21] Appl. No.: 443,521

[22] Filed: Nov. 30, 1989

[51] Int. Cl.[5] ..... H01J 61/67

[52] U.S. Cl. ..... 313/619; 313/620; 313/621; 313/632; 313/642; 313/643

[58] Field of Search ..... 313/619, 639, 642, 643, 313/620, 621, 631, 632; 315/358

[56] References Cited

U.S. PATENT DOCUMENTS

| | | | |
|---|---|---|---|
| 2,003,493 | 6/1935 | Rentschler et al. | 313/621 X |
| 2,507,696 | 5/1950 | Depp | 313/621 X |
| 2,832,912 | 4/1958 | Lake | 313/491 |
| 4,879,493 | 11/1989 | Mastuno et al. | 313/632 X |
| 4,904,900 | 2/1990 | Bouchard et al. | 313/619 |
| 4,929,868 | 5/1990 | Bouchard | 313/619 |

*Primary Examiner*—Donald J. Yusko
*Assistant Examiner*—Ashok Patel
*Attorney, Agent, or Firm*—Carlo S. Bessone

[57] ABSTRACT

A glow discharge lamp includes a light-transmitting envelope containing a rare gas fill material. The envelope contains a spherical-shaped region having a predetermined internal radius R. A phosphor coating is disposed on the inner surface of the envelope. Anode and cathode electrodes are disposed within the envelope and spaced a predetermined distance d thereapart. The voltage drop of the cathode electrode is less than the excitation potential of the rare gas fill material. The anode electrode has a predetermined effective surface area $S_a$ such that the relationship $Rd/S_a$ is within the range of from about 5.0 to 11.0.

5 Claims, 2 Drawing Sheets

GLOW DISCHARGE LAMP HAVING ZERO ANODE VOLTAGE DROP

CROSS-REFERENCE TO RELATED APPLICATIONS

This application discloses, but does not claim, inventions which are claimed in U.S. Pat. No. 4,904,900, which is a continuation-in-part of U.S. Ser. No. 07/139,398, now abandoned, and each of which is assigned to the Assignee of the present application.

FIELD OF THE INVENTION

This invention relates in general to a compact fluorescent lamp and pertains, more particularly, to a negative glow discharge lamp.

BACKGROUND OF THE INVENTION

A negative glow discharge lamp typically is comprised of a light transmitting envelope containing a noble gas and mercury with a phosphor coating on an inner surface of the envelope which is adapted to emit visible light upon absorption of ultraviolet radiation that occurs when the lamp is excited. The lamp is excited by means of the application of a voltage between the lamp electrodes. At least one of the electrodes is in the form of an electron emissive cathode. In a d.c. operated preheat-type lamp having a thermionic cathode and an anode, the cathode is preheated to electron emitting temperature for several seconds. Current flows between the electrodes after a certain potential is applied to the electrodes, commonly referred to as the breakdown voltage. An elementary explanation of the phenomenon is that the gas between the electrodes becomes ionized at a certain voltage, conducts current and emits ultraviolet radiation. The ultraviolet radiation is converted to visible radiation by means of a phosphor layer disposed on the inner surface of the lamp envelope. It is understood that what is meant by a negative glow discharge lamp, as distinguished from a positive column lamp, is one in which the anode is positioned so that no appreciable positive column is developed within the discharge.

As it is known in the art, the following five regions have to be distinguished in a discharge between the thermionic cathode and an anode:

Cathode Sheath Region

The thickness of the cathode sheath is typically equal to $X_c=0.001$ to 0.1 mm. A substantial potential drop $U_c$ exists in this region. Typically, the value of this drop is equal to $U_c=5$ to 20 volts. Electrons emitted from the cathode are accelerated here up to the energy $E=eU_c$.

Negative Glow Region

This region is filled in by the quasineutral plasma produced by the ionizing electron swarm accelerated in the cathode sheath. The value of the electric field E in the negative glow is small i.e., $E=0.1$ to 0.3 volt/cm. Moreover, the electric field is negative. This follows from the fact that the discharge current in this region is mainly due to the electron diffusion towards the anode. In that case, the electric field has to be negative for maintaining quasineutrality of the plasma.

The length of the negative glow region can not exceed a certain maximum length $L_g$. This is due to relaxation of the primary electron swarm and diffusion losses of electrons and ions to the wall of the discharge vessel.

The maximum length $L_g$ scales in accordance with the internal diameter of the discharge vessel D and it is typically equal to $L_g=0.5D$ to 1.5D.

If the distance between electrodes exceeds the maximum possible length of the negative glow, two more regions of the discharge are developed:

Faraday Dark Space and Positive Column Regions

Faraday dark space represents a transitional region between the negative glow and the positive column. In this region, the electric field changes from negative to positive. By this, electrons can be further accelerated for producing ionization to maintain the discharge. The positive column region is filled in by the uniform, quasineutral plasma, in which the potential varies linearly with the distance. The constant positive value of the electric field is determined here by the equilibrium between processes of ionization and diffusion loss of electrons and ions to the wall.

Anode Sheath Region

This region is developed in the close vicinity to the anode. The thickness of the anode sheath is in the order of 1 mm. The potential drop $U_a$ in the anode sheath may be positive or negative depending upon conditions.

U.S. Pat. No. 2,832,912, which issued to Lake on Apr. 29, 1958, relates to a glow discharge lamp including a filamentary cathode and an anode consisting essentially of titanium metal. In the paragraph bridging columns 5 and 6, Lake discloses that the anode fall of the lamp (or the anode potential drop) is negative as indicated in FIG. 2 therein. Moreover, Lake teaches that in most discharge lamps where the size of the anode is much less than the cross section of the discharge column, electrons must be accelerated in order to reach the anode in sufficient quantities and the anode fall is positive.

We have discovered that by having a substantially negative or positive anode fall in a negative glow discharge lamp results in a lamp efficacy which is less than optimum.

SUMMARY OF THE INVENTION

It is, therefore, an object of the present invention to obviate the disadvantages of the prior art.

It is still another object of the invention to provide an improved negative glow discharge lamp.

It is another object of the invention to provide a negative glow discharge lamp having increased lamp efficacy.

These objects are accomplished in one aspect of the invention by the provision of a glow discharge lamp including a light-transmitting envelope containing a rare gas fill material. The envelope includes a spherical-shaped region having a predetermined internal radius R. A phosphor coating is disposed on the inner surface of the envelope. An anode electrode and a cathode electrode are disposed within the envelope and spaced a predetermined distance d thereapart. The voltage drop $U_c$ of the cathode is less than the excitation potential of the rare gas fill material. The anode electrode has a predetermined effective surface area $S_a$ such that the relationship $Rd/S_a$ is within the range of from about 5.0 to 11.0.

In accordance with further teachings of the present invention, the rare gas fill mixture consisting of helium, neon, argon, krypton or xenon and combinations thereof. In one embodiment, the rare gas fill mixture includes helium, neon, argon, krypton or xenon and the cathode voltage drop is less than 20 volts for helium, less than 17 volts for neon, less than 12 volts for argon, less than 10 volts for krypton and less than 9 volts for xenon.

In accordance with further aspects of the present invention, the relationship $Rd/S_a$ is equal to about 7.5.

In accordance with still further teachings of the present invention, the envelope also contains mercury and emits ultraviolet radiation upon excitation. Preferably, the phosphor coating disposed on an inner surface of the envelope emits visible light upon absorption of ultraviolet radiation.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
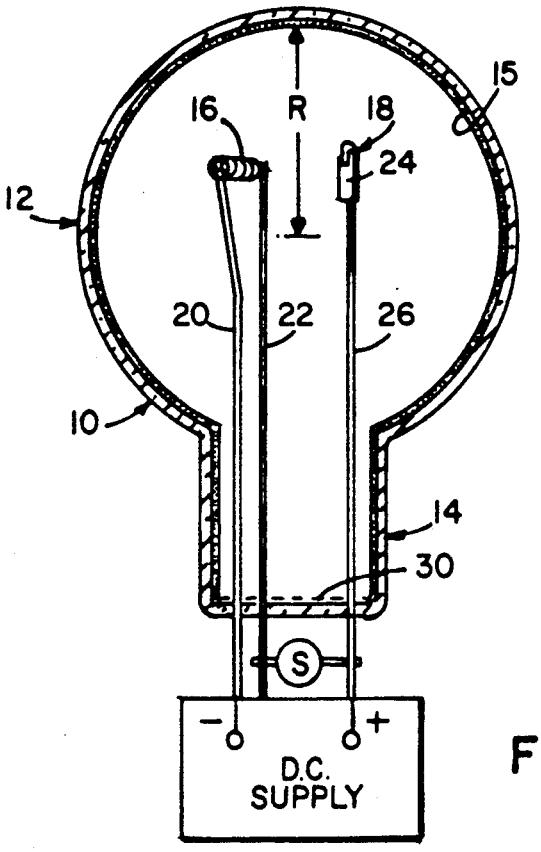
FIG. 1 is a front elevation cross-sectional view of a preferred embodiment of a glow discharge lamp constructed in accordance with the principles of the present invention.

Referring to the drawings, FIG. 1 illustrates a negative glow discharge lamp including a light-transmitting envelope 10 that has a bulbous or spherical-shaped region 12 and a neck region 14. Region 12 of envelope 10 has an internal radius R, such as, 3.5 centimeters. Within spherical-shaped region 12 of envelope 10 there is disposed a pair of electrodes such as a cathode electrode 16 and an anode electrode 18. The electrodes are typically spaced approximately 1 to 3 centimeters apart. The cathode electrode 16 may be a tungsten exciter coil having a co-precipitated triple carbonate suspension, usually comprising strontium carbonate, calcium carbonate, and barium carbonate deposited thereon. The cathode electrode can vary in size, mass and geometry depending on starting features required, expected life and current carrying capabilities. During lamp manufacturing, the carbonates are converted to oxides during the well known breakdown or activation process in which current is passed through the cathode for a predetermined amount of time. Lead-in wires 20 and 22 support cathode electrode 16 and provide electrical power thereto. Anode electrode 18 comprises a refractory metal strip 24 supported by a single lead-in wire 26. Lead-in wires 20, 22, 26 are hermetically sealed such as by means of a wafer stem assembly 30 that closes the bottom neck region 14 of the lamp envelope as illustrated in FIG. 1. The lead-in wires may be rod-like of say 20 to 30 mil diameter.

As further shown in FIG. 1, lead-in wire 20 and 26 are respectively connected to the negative and positive terminals of a d.c. power supply. To start the lamp, preheat current is supplied to cathode electrode 16 by momentarily connecting together lead-in wires 22 and 26. As illustrated in FIG. 1, a conventional glow discharge starters may be secured to lead-in wires 22 and 26 to facilitate the preheating and starting. Upon ignition, a glow discharge is produced between cathode electrode 16 and anode electrode 18.

The envelope contains an ionizable medium that emits ultraviolet radiation upon excitation. This ionizable medium may contain mercury and a rare gas, such as helium, neon, argon, krypton and xenon or a mixture of rare gases. In one embodiment, the lamp may be filled with a noble gas mixture at 3 torr. This mixture may be 99.5% neon and 0.5% argon with approximately 30 milligrams of mercury. The inner surface of lamp envelope 10 has a phosphor coating 15 which emits visible light upon absorption of ultraviolet radiation.

Figure 2A:
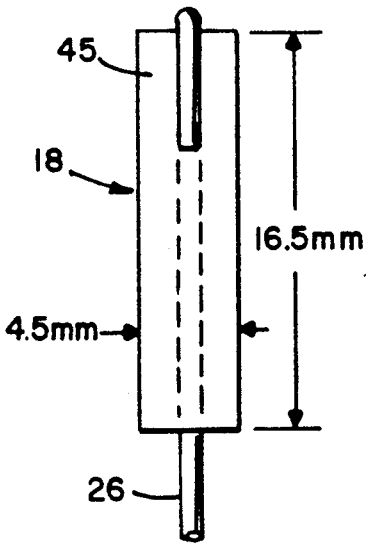
FIGS. 2A and 2B are respective front and side, enlarged, elevation views of a preferred anode construction.
Figure 2B:
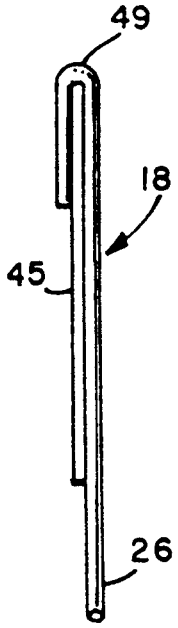
Figure 3:
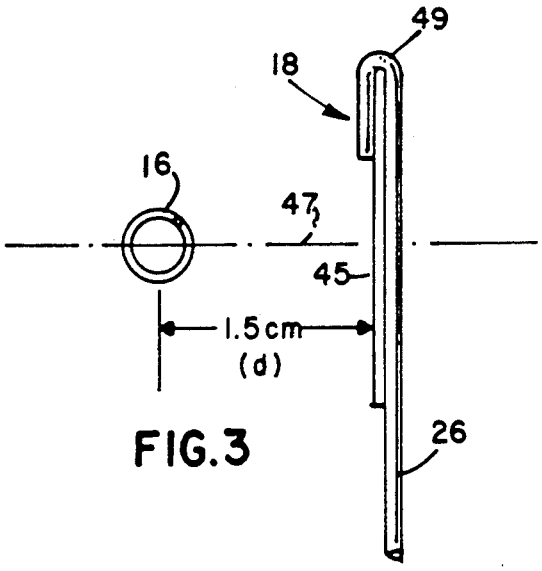
FIG. 3 is an enlarged detailed diagram illustrating the anode and cathode constructions and the relative positioning therebetween.

In accordance with the teachings of U.S. Pat. No. 4,904,900, the anode electrode 18 is preferably constructed of an inexpensive strip of molybdenum foil 45 as best illustrated in FIGS. 2A, 2B and 3. In one embodiment, the molybdenum foil is 4.5 mm wide, 16.5 mm long (refer to FIG. 2A) and 0.01 mm thick (refer to FIG. 2B) having an effective anode surface area $S_a$ of 74.46 $mm^2$. The value of $S_a$ is defined as being equal to one-half of the geometric surface area S of the anode, i.e., $S_a = S/2$. The molybdenum foil strip 45 may be secured to the lead-in wire 26 by providing a turned end 49 on the very end of the lead-in wire 26. This permits the end 49 to be swagged securing the molybdenum foil strip at its very top end therebetween. In addition, one may provide a solder, adhesive or weld seal between the lead-in wire 26 and foil strip 45.

The anode may have a construction other than that shown in FIGS. 1, 2A, 2B and 3. For example, the anode may be a tungsten exciter coil devoid of the co-precipitated triple carbonate suspension normally found on the cathode.

As shown in FIG. 3, a preferred spacing d between the anode and cathode electrodes is approximately 1.5 cm. The cathode and anode electrodes are preferably approximately centered relative to each other as also illustrated in FIG. 3. In this regard, note in FIG. 3 the representative center line 47. In addition to using a molybdenum foil strip one may also use a strip of tungsten or tantalum.

As previously stated, the present invention deals with a discharge in an envelope having a spherical-portion. Accordingly, the maximum length of the negative glow is always close to the discharge vessel diameter and no significant region of the positive column can be developed in the case of practical values of the bulb diameter. Thus, the discharge voltage $U_d$ in such a lamp can be closely represented by the sum of the cathode and anode potential drops as $U_d = U_c + U_a$. It has been discovered that both values of $U_c$ and $U_a$ affect the efficacy of the lamp. In the case of the mercury vapor and rare gas mixture, the value of $U_c$ should be less than the excitation potential of the rare gas for good lamp efficacy. If the value of $U_c$ is greater than the excitation potential, a great amount of energy is spent for excitation of the rare gas and the efficacy is greatly reduced. Thus, optimum efficacy of a negative glow discharge lamp filled by a mixture of mercury vapor and a rare gas should have the cathode voltage drop less than 20 volts for helium, less than 17 volts for neon, less than 12 volts for argon, less than 10 volts for krypton and less than 9 volts for xenon.

Effects of the value of anode voltage on the discharge efficacy can be considered in a calculational model of the lamp. Calculations can be performed based on the volume averaged equation of the electron energy balance in the form:

$$I_{ec}U_c/V=P_x+P_i+P_w+P_{el}+P_a \quad (1)$$

where, $I_{ec}$ equals the electron current from the cathode;

$U_c$ equals the cathode voltage drop;

V equals the volume of plasma between cathode, anode and wall sheaths;

$P_x$, $P_i$, $P_w$ and $P_{el}$ equal the energy losses due to excitation, ionization, electron escape to the wall and elastic collisions, respectively; and $P_a$ equals the energy loss due to electron escape to the anode.

This latter term can be represented in the form:

$$P_a=I_{ea}\epsilon_a/eV \quad (2)$$

where, $I_{ea}$ equals the electron current to the anode;

$\epsilon_a$ equals the average energy of electrons escaping from the plasma to the anode; and e equals the absolute value of electron charge.

The expression for $\epsilon_a$ has two different forms which are dependent on the sign of the anode voltage drop $U_a$. For example, in the case of $U_a \geqq 0$, $$\epsilon_a=2\ kT_e \quad (3)$$

where, k is the Botzmann constant; and $T_e$ is the electron temperature.

In the case where $U_a<0$, $$\epsilon_a=2kT_e-eU_a \quad (4).$$

The lumen output L can be calculated from equations 1 through 4. The discharge efficacy, expressed as lumens per watt (LPW), can be found according to the equation:

$$LPW=L/IU_d \quad (5)$$

where,

I is the lamp current; and $U_d$ is assumed to be equal to the discharge voltage (i.e., $U_c+U_a$).

Assuming a fixed value of cathode voltage drop, according to equations 2, 3 and 5, a positive anode voltage drop should result in a smaller lamp efficacy, if one neglects small excitation in the anode sheath.

In the case of a negative anode voltage drop, the situation is less obvious. According to equation (4), a negative anode voltage results in an additional cooling of plasma electrons. This tends to reduce the lumen output. An opposite trend exists due to the decrease of the discharge voltage in the denominator of the equation (5). The net result has been obtained by calculations.

Figure 4:
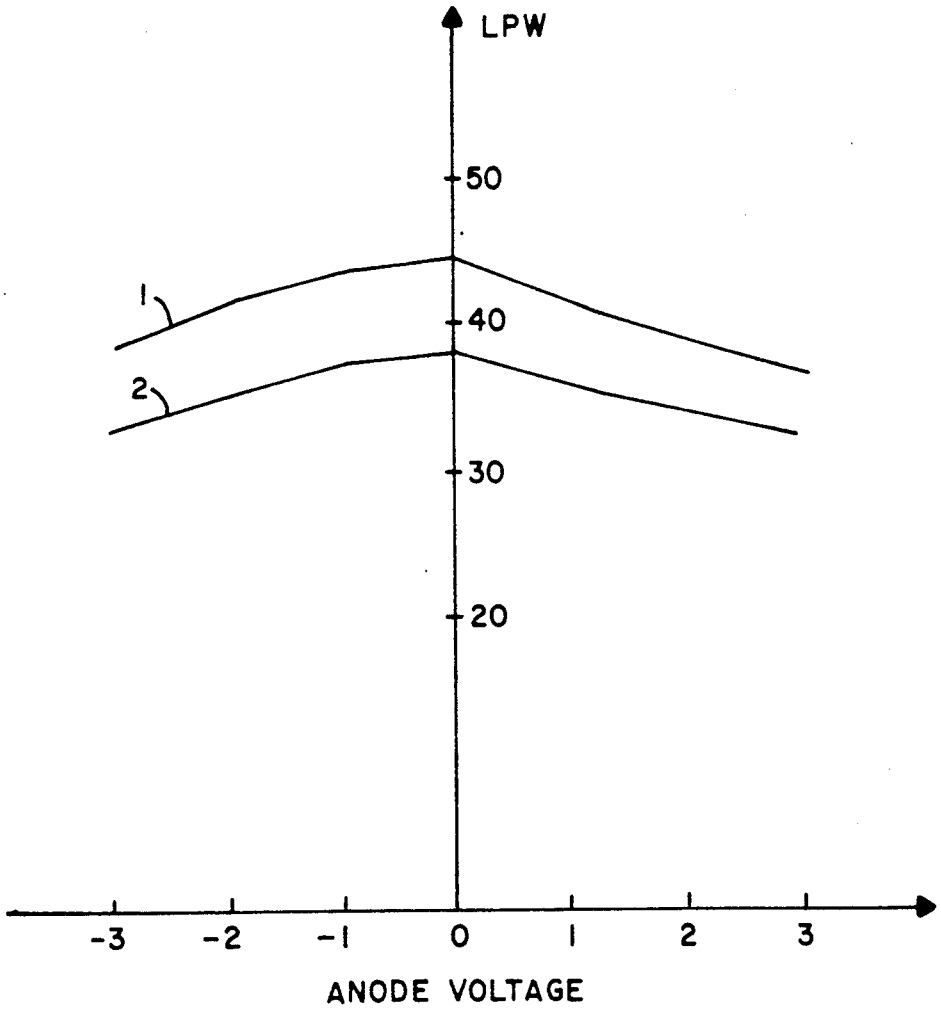
FIG. 4 is a graph depicting the lamp efficacy (LPW) as a function of the anode voltage for a glow discharge lamp having cathode voltages of 13 volts (curve 1) and 15 volts (curve 2).

Calculations can be performed with the anode voltage as a variable parameter. Lamp efficacy expressed as lumens per watt (LPW) is plotted as a function of the anode voltage in FIG. 4 for the typical conditions of a glow discharge lamp containing 100% neon at a pressure of 3.0 torr and with a mercury vapor pressure of 7.0 microns. The spherical portion of the envelope had an internal radius of 3.5 centimeters. The lamp had an operating current of 2.0 amps. Curves 1 and 2 in FIG. 4 illustrate cathode voltages of 13 and 15 volts, respectively. Data from FIG. 4 indicate that the optimum efficacy is attained at $U_a=0$. The sign of the anode potential drop depends on the values of the random electron current to the anode $I_r$ and the lamp current I. The random electron current to the anode is equal to $$I_r=eN_ev_eS_a/4 \quad (6)$$

where, $v_e$, $N_e$ equal the random velocity and number density of electrons at the beginning of the anode sheath, respectively; and $S_a$ equals the effective surface area of the anode (i.e., one-half of the geometric surface area S of the anode).

If the value of random electron current $I_r$ is greater than the discharge current I, then the anode voltage drop $U_a$ is negative, since some electrons have to be repulsed from the anode. If the value of random current is less than the discharge current, then the anode voltage drop is positive, since additional electrons have to be subtracted from the plasma to the anode.

According to FIG. 4, it can be seen that optimum efficacy occurs when the random electron current $I_r$ equals the discharge current I and the anode voltage drop is equal to zero. As it follows from the equation (6), the sign and the value of the anode voltage drop depends on the distance between anode and cathode via the electron number density. If the distance increases, the electron density at the anode decreases and the anode voltage drop increases and vice versa.

An optimum distance exists which corresponds to the anode voltage close to zero. Based on modelling, the electron density in the equation (6) can be represented as $$N_e=aI/Rd \quad (7)$$

where, a is a constant;

R equals the internal bulb radius; and d equals the distance between electrodes.

Thus, the optimum efficacy corresponds to the following relationship between the internal bulb radius R, distance between electrodes d and the effective anode surface area $S_a$:

$$Rd/S_a=\text{constant} \quad (8).$$

As it follows from our experimental results, the constant in the equation (8) is equal to 7.5. Since the fall off from optimum efficacy proceeds smoothly, it has been discovered that conditions remain close to optimum if the constant in the equation (8) falls in the range of from about 5.0 to 11.0.

There has thus been shown and described an improved glow discharge lamp. The invention provides an improvement in lamp efficacy over the prior art.

While there have been shown and described what are at present considered to be the preferred embodiments of the invention, it will be apparent to those skilled in the art that various changes and modifications can be made herein without departing from the scope of the invention. The embodiments shown in the drawings and described in the specification are intended to best explain the principles of the invention and its practical application to hereby enable others in the art to best utilize the invention in various embodiments and with various modifications as are suited to the particular use contemplated.

What is claimed is:

1. A glow discharge lamp comprising:

a light-transmitting envelope containing a rare gas fill material, said envelope including a spherical-shaped region having a predetermined internal radius R;

a phosphor coating disposed on the inner surface of said envelope; and anode and cathode electrodes disposed within said envelope and spaced a predetermined distance d thereapart, said cathode having a voltage drop less than an excitation potential of said rare gas, said anode electrode having a predetermined effective surface area $S_a$, such that a relationship $Rd/S_a$, is within a range of from about 5.0 to 11.0.

2. The glow discharge lamp of claim 1 wherein said rare gas fill mixture consists of helium, neon, argon, krypton or xenon and combinations thereof.

3. The glow discharge lamp of claim 1 wherein said relationship is equal to about 7.5.

4. The glow discharge lamp of claim 1 wherein said envelope also contains mercury and emits ultraviolet radiation upon excitation.

5. The glow discharge lamp of claim 4 wherein said phosphor coating on said inner surface of the envelope emits visible light upon absorption of ultraviolet radiation.

* * * * *